US006782670B2

(12) United States Patent
Wendt

(10) Patent No.: US 6,782,670 B2
(45) Date of Patent: Aug. 31, 2004

(54) MULTI-PLANAR CEILING SYSTEM

(75) Inventor: Alan C. Wendt, Barrington, IL (US)

(73) Assignee: USG Interiors, Inc., Chicago, IL (US)

( * ) Notice: Subject to any disclaimer, the term of this patent is extended or adjusted under 35 U.S.C. 154(b) by 146 days.

(21) Appl. No.: 10/034,471

(22) Filed: Dec. 28, 2001

(65) Prior Publication Data

US 2003/0121227 A1 Jul. 3, 2003

(51) Int. Cl.[7] ..... E04B 2/00; E04B 5/00; E04B 9/00

(52) U.S. Cl. ..... 52/506.07; 52/473; 52/506.01; 52/506.06; 52/384; 52/311.1; 52/387

(58) Field of Search ..... 52/220.3, 220.6, 52/473, 506.01, 506.04, 506.07, 145, 475.1, 489.1, 506.06, 474, 479, 311.2, 314, 488, 316, 311.1, 387, 489, 384; D25/138

(56) References Cited

U.S. PATENT DOCUMENTS 2,935,152 A 5/1960 Maccaferri
5,044,103 A * 9/1991 Izenberg ..... 40/617

OTHER PUBLICATIONS

USG Interiors, Inc., Lightrium Specification Guide, 4 pages.

USG Interiors, Inc., Literature No. 1C305 Cadre Contemporary (six sheets).

* cited by examiner

*Primary Examiner*—Carl D. Friedman
*Assistant Examiner*—Chi Q. Nguyen
(74) *Attorney, Agent, or Firm*—Barnes & Thornburg LLP; Glenn W. Ohlson; John M. Lorenzen

(57) ABSTRACT

The present invention relates to a novel ceiling panel that is used with a corresponding grid system to create a shingle-type ceiling structure. The panels, are arranged in the grid system to create various patterns including shingles, saw teeth, undulations, pin wheels, among others and are designed to enhance the appearance of retail and office space. The ceiling is comprised of a grid system made up of intersecting grid members suspended from the building structure with hangers. The grid members are rigid pre-formed members that include a base portion a bridge portion and a bulb portion. The base portion is perpendicularly oriented to the bridge member and is adapted to support the panels. The panels are square when viewed in plan view but have a tapered cross-section about all or part of the panels. The panels can be fabricated out of polycarbonate or metal and can be opaque or translucent. The panels are arranged in the grid in a fashion so that certain repeating patterns are formed when viewed from below.

11 Claims, 12 Drawing Sheets

MULTI-PLANAR CEILING SYSTEM

BACKGROUND OF THE INVENTION

The present invention relates generally to suspended ceiling systems and more particularly to novel ceiling panels that are designed to create a multi-planar appearance when installed into a horizontally oriented grid structure.

PRIOR ART

Suspended ceiling systems typically include grid members that provide for oppositely extending ceiling panel support flanges. The grid members are interconnected to form a grid and are suspended from the structure of a building with wire hangers or rods. In these systems, the edges of the ceiling panels are installed by laying the panels in the grid opening created by the grid members. Once the ceiling panels are installed into the grid, a uniform ceiling surface is created. Suspended ceiling panels are manufactured from gypsum or slag wool fiber and are designed to conceal pipes, wiring and the like, while still allowing access to the concealed space above the ceiling. Typical ceiling panels are fabricated out of sound deadening and insulating material and are designed to meet fire safety codes. The acoustical panels are planar appearance and do little to enhance a room's decor. The acoustical panels also may include surface impressions and markings to enhance their appearance. When the panels are installed in the grid, the overall appearance of the ceiling is a generally planar. Prior art panels do not provide for a ceiling system that utilizes tapered ceiling panels to vary the appearance of the ceiling.

SUMMARY OF THE INVENTION

This invention may be described as novel ceiling panels that are used with a corresponding grid system to create a multi-planar ceiling system. The panels, can be installed in the grid system in different arrangements to create various patterns including shingles, saw teeth, undulations, pin wheels, among others and are designed to enhance the appearance of retail and office space that utilize suspended ceilings to conceal the building structure. The ceiling is comprised of a grid system made up of intersecting grid members suspended from the building structure with hangers. The grid members are interconnected with grid clips to form openings that accept the panels. The grid members are rigid preformed members that include a base portion, a bridge portion and a bulb portion. The base portion is perpendicularly oriented to the bridge member and is adapted to support the panels. The panels are square when viewed in plan view but have a tapered cross-section about all or part of the panels. The panels can be fabricated out of plastic, gypsum, slag wool, or metal, and can be opaque or translucent. The panels are arranged in the grid in a fashion so that certain repeating patterns are formed when viewed from below. To create a shingled pattern, all of the panels are arranged in the same direction. To create a saw-tooth pattern, the direction of the panels are alternated in adjacent rows.

These and other aspects of this invention are illustrated in the accompanying drawings, and are more fully described in the following specification.

DETAILED DESCRIPTION OF THE INVENTION

While the present invention will be described fully hereinafter with reference to the accompanying drawings, in which a particular embodiment is shown, it is understood at the outset that persons skilled in the art may modify the invention. Accordingly, the description which follows is to be understood as a broad informative disclosure directed to persons skilled in the appropriate arts and not as limitations of the present invention.

Figure 1:
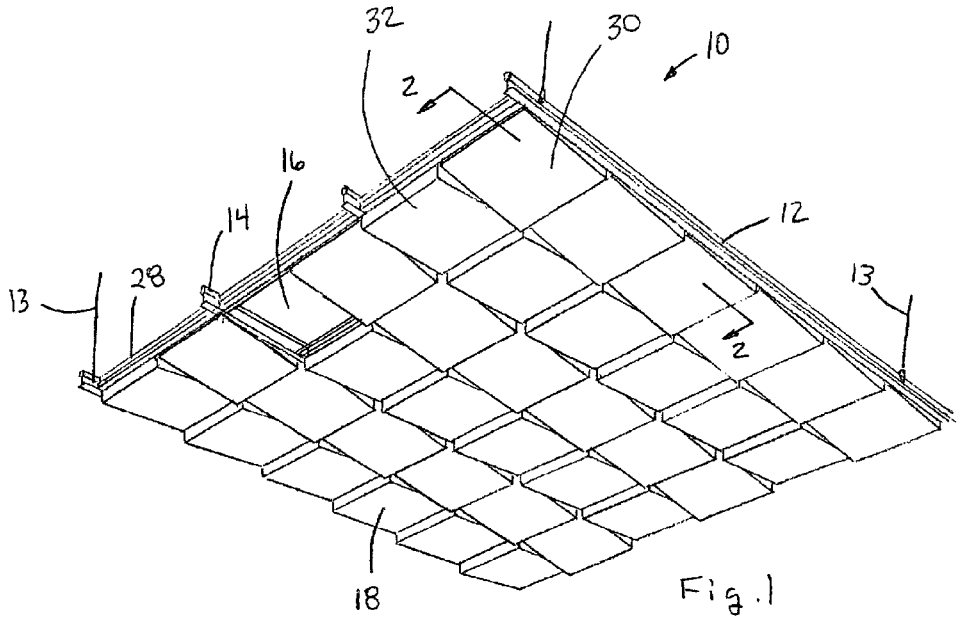
FIG. 1 is a perspective view of the ceiling system of the present invention with the panels oriented in a saw-tooth pattern.

FIG. 1 illustrates a portion of an assembled multi-planar ceiling system 10 with the panels arranged in a saw-tooth pattern. The multi-planar ceiling system 10 is comprised of a grid 12 that is made up of a plurality of intersecting grid members 14. The grid members 14 are arranged to form openings 16 that are sized to receive tapered panels 18. The grid 12 is suspended from a building structure by wire hangers 13 or other supporting devices and, when the panels are installed, it is designed to conceal utilities.

Figure 2:
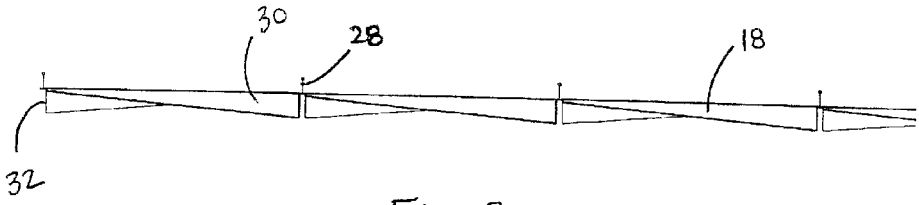
FIG. 2 is a cross-section of FIG. 1 taken along line 2—2 illustrating the panels suspended from grid members.
Figure 3:
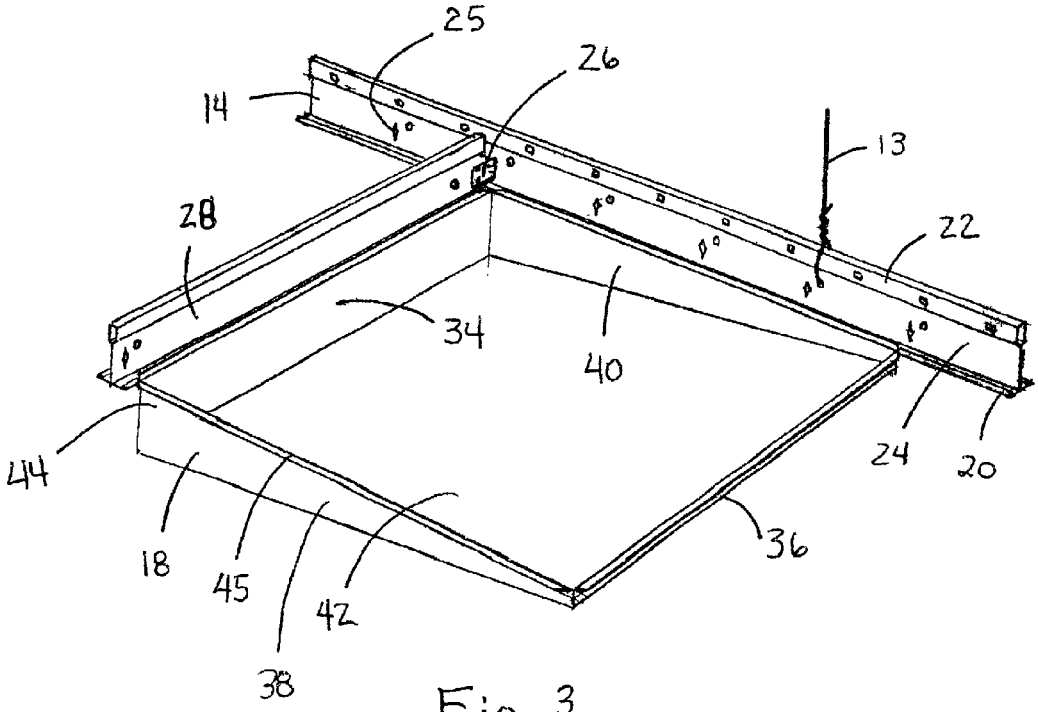
FIG. 3 is a perspective view of a tapered ceiling panel supported by a pair of intersecting grid members.

The grid members 14, shown best in FIG. 3, have a T-shaped cross section and include a horizontally oriented base member 20, a bulb portion 22 and a bridge member 24 interconnecting the bulb portion 22 to the base member 20. The bridge member 24 includes a plurality of openings 25 to allow for the attachment of hanger devices and to allow for the attachment of grid clips 26. The grid members 14 are manufactured in three preferred lengths, 12 feet, 4 feet and 2 feet, although other lengths may be used. To create the grid structure 12, a row of parallel evenly spaced grid members 14 are suspended by wire hangers. Each row of grid members 14 are spaced apart to accommodate the size of the tapered panels 18. To accommodate a 2-foot by 2-foot ceiling panel, the grid members 14 would be spaced apart 2 feet on-center. The grid 12 also includes a second set of grid members 28 that are perpendicularly oriented in relation to the first set of grid members 14 to create the opening 16 required for suspending the panels 18. The tapered panels 18, as illustrated in FIG. 1, are arranged so that the panels 18 in a first row 30 are positioned in a direction that is 180 degrees out of phase with the panels 18 in a second row 32. This arrangement creates a saw-tooth appearance when the ceiling system 10 is viewed from below. FIG. 2 illustrates the orientation of the panels 18 in the grid 12 when positioned to form the saw tooth pattern. The tapered panels 18, as shown in FIG. 3, have a square configuration and includes four upwardly extending sides 34, 36, 38 and 40 interconnected by a tapered bottom layer 42. Each of the four sides 34, 36, 38 and 40 includes an upper end 44 with an outwardly extending flange 45 that is adapted to be supported by the base member 20 of the grid members 14. The flange 45 is oriented to the sides 34, 36, 38 and 40 at an angle that allows the sides 34, 36, 38 and 40 of the panel 18 to be substantially parallel to the bridge portion 24 of the grid members 14. The first side 34 opposes the second side 36 and is rectangular in shape. The first side 34 of the panel 18 has a surface area that is larger than the second side 36. The third and fourth sides 38 and 40 are triangular shaped tapering from the first side 34 to the second side 36. The flanges 45 of the sides 34, 36, 38 and 40 all lie in the same plane so they can be supported by the grid members 14. The panels 18 can be fabricated out of sheet steel where they are formed into the desired configuration. Faces of the panels can be perforated or slotted. The panels can also be thermoformed or molded out of plastic to create the desired panel. Plastic panels can be made either translucent or opaque depending upon whether lighting is used or if a certain optical effect is required by the architect.

Figure 4:
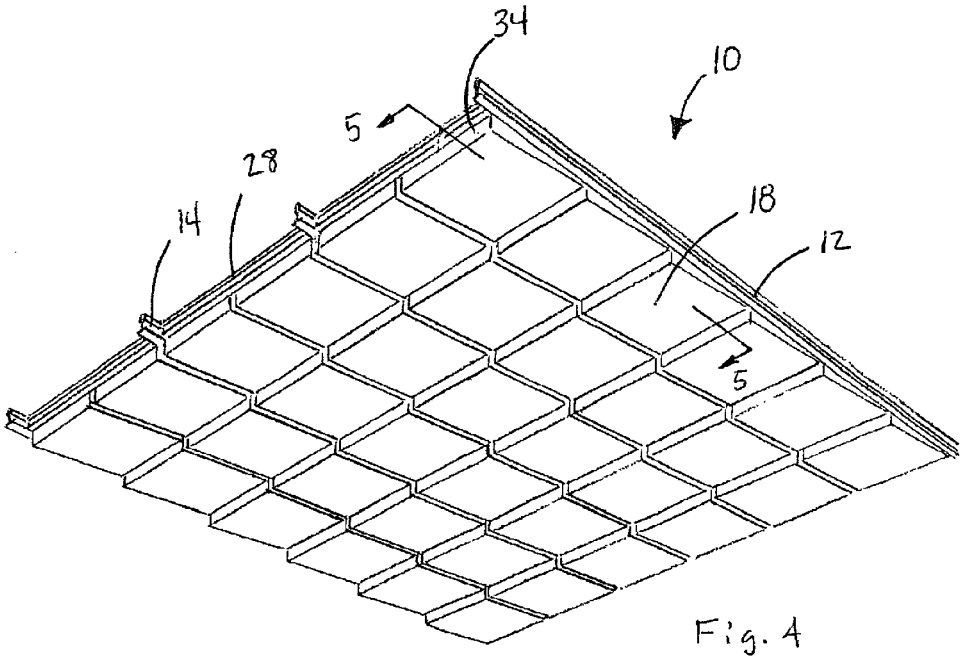
FIG. 4 is a perspective view of the ceiling system of the present invention with the panels oriented in a shingle pattern.
Figure 5A:
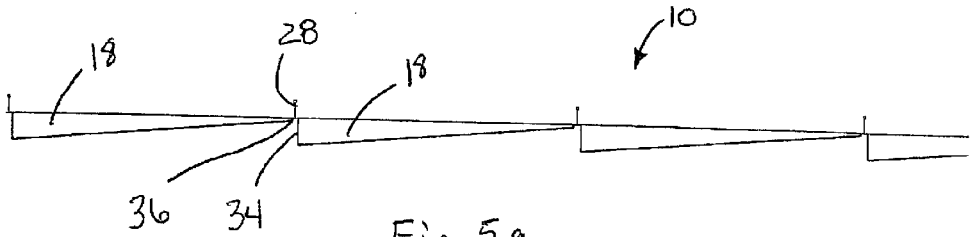
FIG. 5*a* is a cross-section of FIG. 4 taken along line 5—5 illustrating the panels suspended from horizontal grid members.

FIG. 4 illustrates the tapered ceiling panel system 10 wherein the tapered panels 18 are arranged in a uniform direction in the grid 12 to create a shingle pattern. The panels are arranged so that the first side 34 of the panels 18 are all facing the same direction. FIG. 5*a* is a cross section taken along line 5—5 of FIG. 4 illustrating the orientation of the panels 18 in the grid 12. The panels 18 are oriented in the grid 12 so that the first side 34 of a first panel 18 is adjacent to the second side 36 of a second panel 18.

Figure 5B:
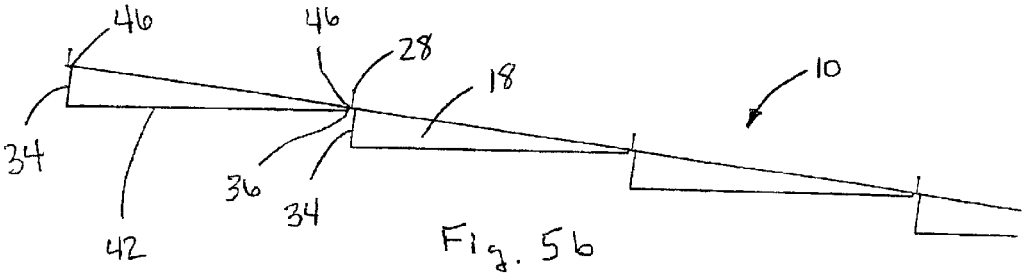
FIG. 5*b* is a variation of the grid system of FIG. 4 in that the grid system is sloped to alter the elevation of the panels.

FIG. 5*b* illustrates the ceiling system 10 wherein the rows of parallel grid members 14 are arranged having varied elevations so that the base member 20 of a grid member 28 is higher than the base member 20 of adjacent grid member 28. The panels 18 are arranged in the grid so that the flange 45 of the first side 34 is connected to the grid member 28 of a higher elevation than the flange 45 of the second side 36, which is connected to the grid member 28 of the lower elevation. With this grid arrangement, the bottom layer 42 of the panels are parallel with the floor of the building structure.

Figure 6:
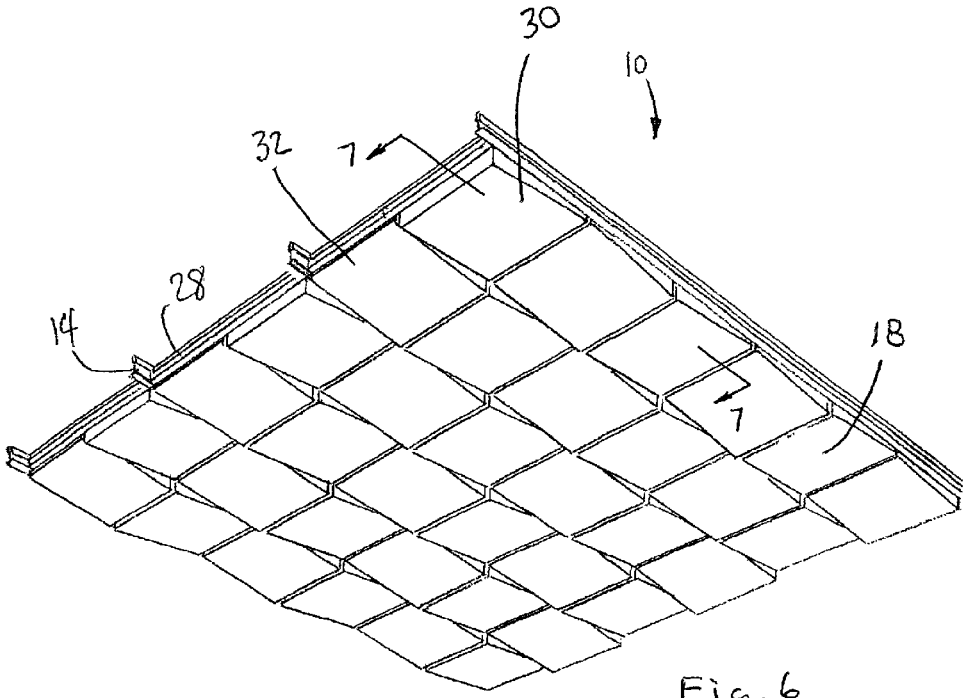
FIG. 6 is a perspective view of the ceiling system of the present invention with the panels oriented in an alternating row undulating pattern.
Figure 7:
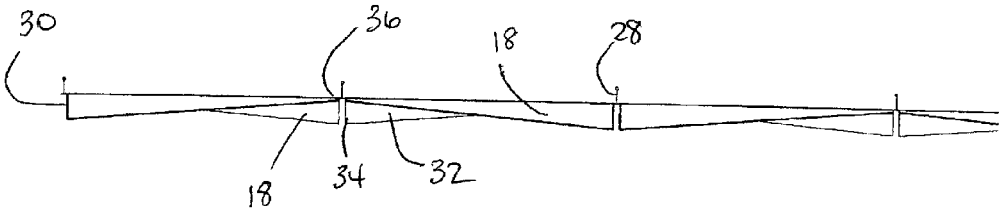
FIG. 7 is a cross-section of FIG. 6 taken along line 7—7 illustrating the panels suspended from the grid members.

FIG. 6 illustrates the tapered panel ceiling system 10 wherein the tapered panels 18 are arranged to form an alternating undulating pattern. The panels 18 in the first row 30 are arranged so that similar sides of adjacent panels 18 are abutting. The second row 32 of panels 18 are arranged in a similar fashion but are oriented out of phase from the first row. FIG. 7 illustrates the second sides 36 of adjacent panels 18 in the first row 30 are in line with the first sides 34 of adjacent panels 18 in the second row 32 creating an alternating undulating pattern.

Figure 8:
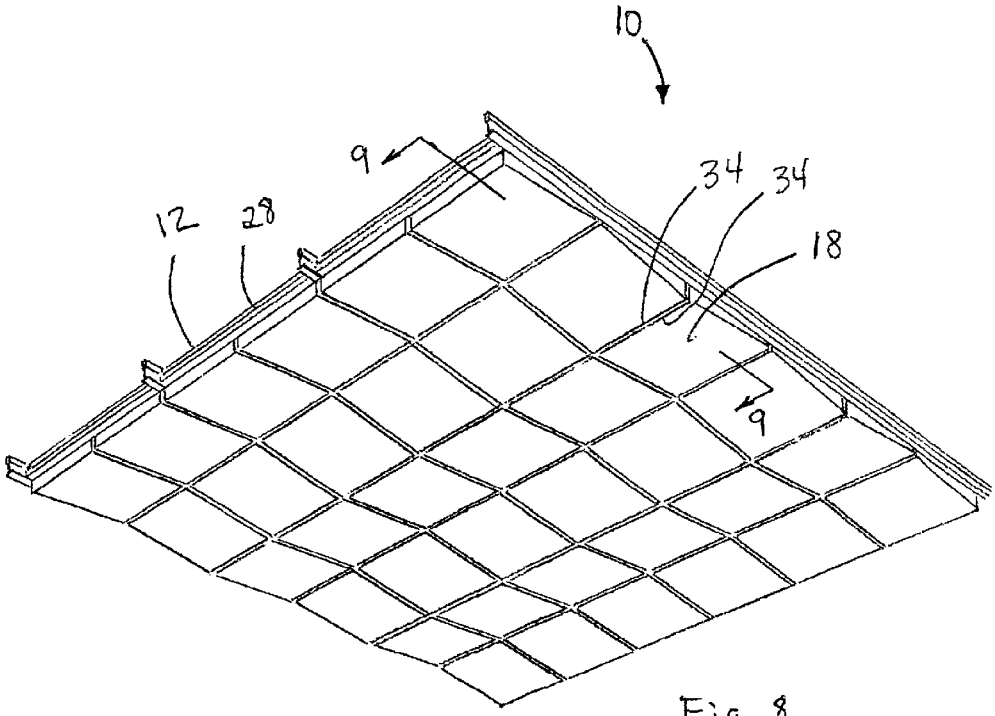
FIG. 8 is a perspective view of the ceiling system of the present invention with the panels oriented in an alternate undulating pattern.
Figure 9:
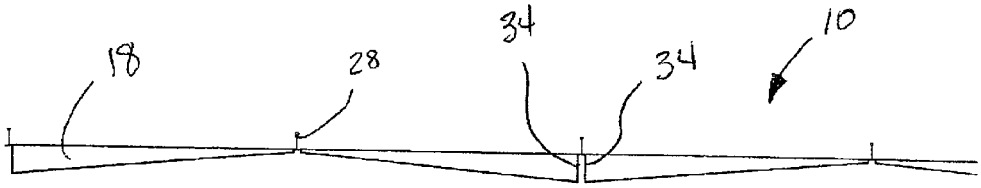
FIG. 9 is a cross-section of FIG. 8 taken along line 9—9 illustrating the panels suspended from the grid members.

FIG. 8 illustrates the tapered panel ceiling system 10 where the tapered panels 18 are arranged to form a uniform undulating pattern. The panels 18 are arranged in the grid 12 so that similar sides of the panels 18 are abutting. FIG. 9 illustrates that the panels 18 in each row are oriented with the first side 34 of the first panel 18 adjacent with a first side 34 of the second panel 18.

Figure 10:
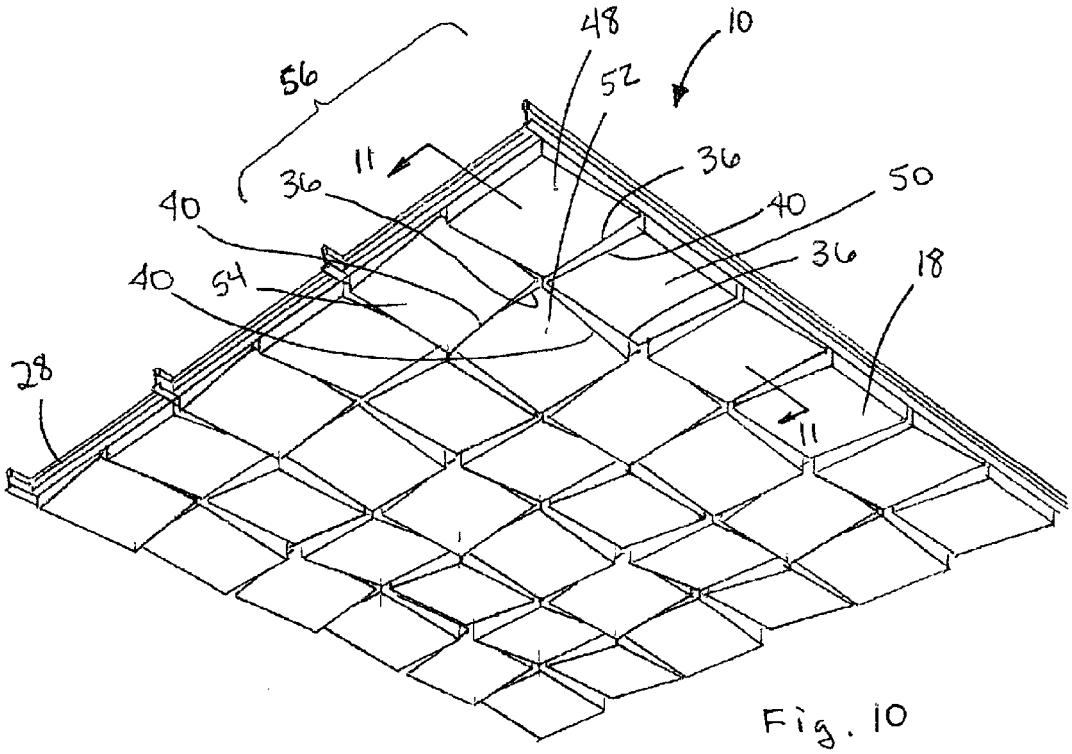
FIG. 10 is a perspective view of the ceiling system of the present invention with the panels oriented in a pinwheel pattern.
Figure 11:
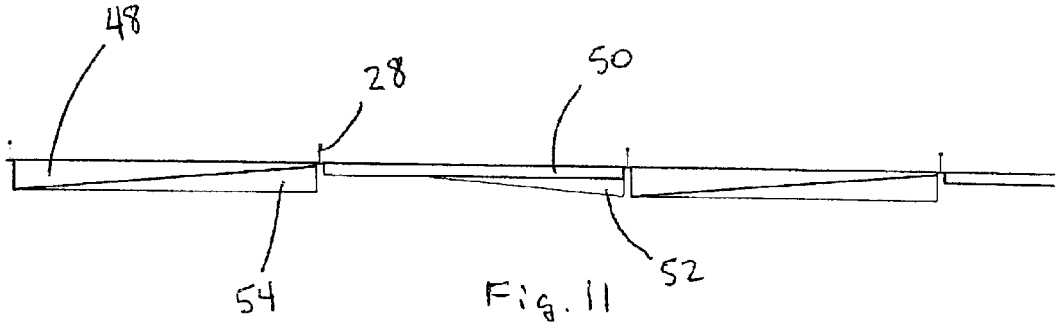
FIG. 11 is a cross-section of FIG. 10 taken along line 11—11 illustrating the panels suspended from the grid members.

FIG. 10 illustrates the tapered panel ceiling system 10 where the tapered panels 18 are arranged to form a pinwheel pattern. To create the pinwheel effect, the panels 18 are arranged 90 degrees out of phase with an adjacent panel 18. The second side 36 of a first panel 48 is adjacent to the third side 40 of a second panel 50. The second side 36 of the second panel 50 is adjacent to the third side 40 of a third panel 52. The second side 36 of the third panel 52 is adjacent to the third side 40 of a fourth panel 54. The orientation of the four panels 48, 50, 52 and 54 creates a pinwheel quadrant 56. The remainder of the grid 12 is filled in with pinwheel quadrants 56 of the same configuration, creating a repeating pinwheel pattern. FIG. 11 illustrates a cross-section of FIG. 10 illustrating the arrangement of the four panels 48, 50, 52 and 54 that make up a pinwheel quadrant 56. Each panel 48, 50, 52 and 54 is supported by the grid members 28.

Figure 12:
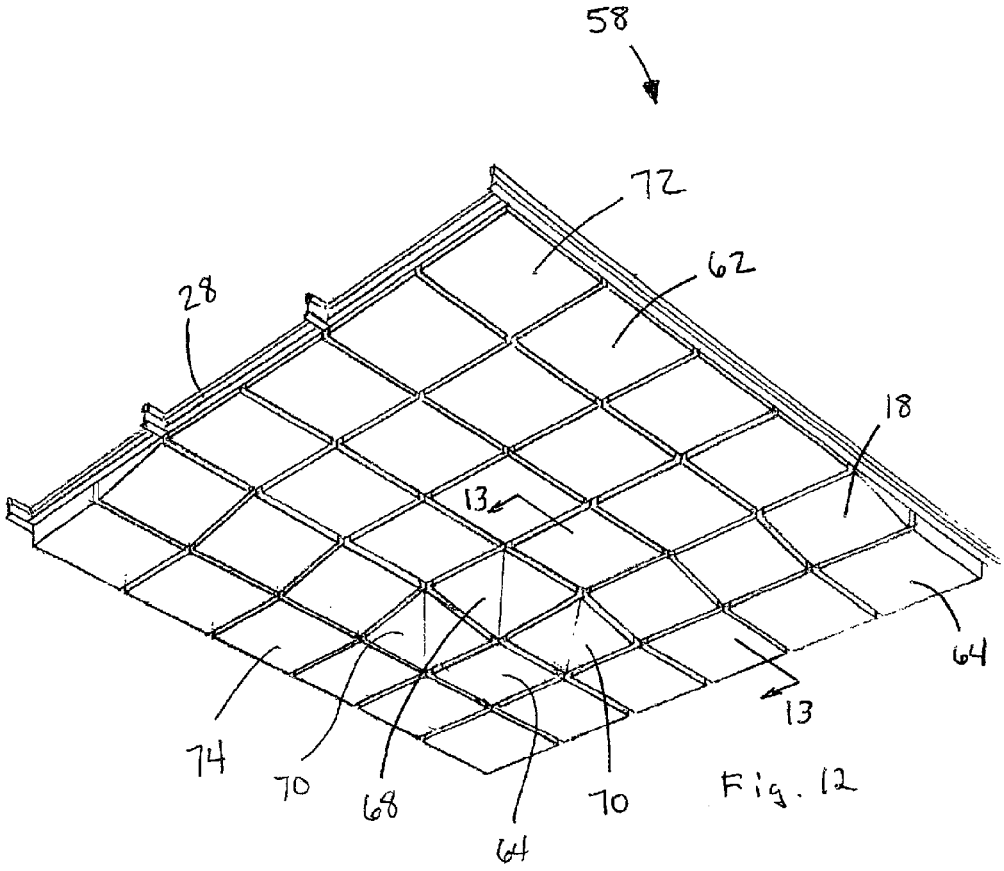
FIG. 12 is a perspective view of the ceiling system illustrating a transition from a first elevation to a second elevation by use of tapered panels.
Figure 13:
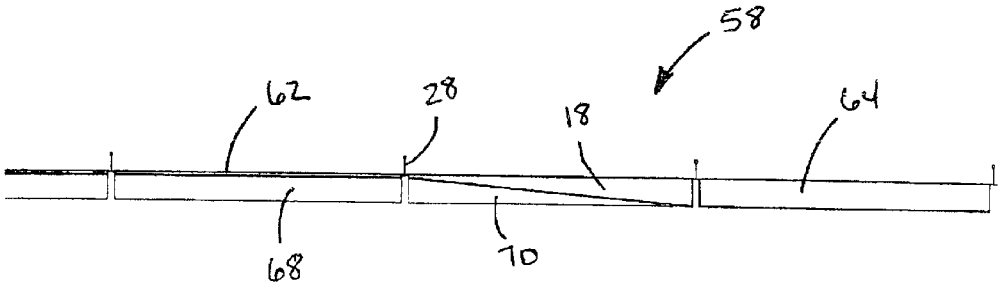
FIG. 13 is a cross-section of FIG. 12 taken along line 13—13 illustrating the panels suspended from the grid members.

FIG. 12 illustrates a variable depth ceiling system 58 where five different panels 62, 64, 18, 68 and 70 are utilized to transition the ceiling 58 from a high elevation 72 to a low elevation 74. The higher elevation 72 is comprised of the shallow panels 62 with panel faces that are closer to the grid 12. The lower elevation 74 is comprised of the deep panels 64 that extend the panel faces further away from the grid 12. The shallow panels 62 transition to the deep panels 64 by use of the tapered panels 18. To transition from the shallow panels 62 to the deep panels 64 in a corner region, two different transition panels are used. The first transition panel 68, shown in FIG. 20, includes two edges 76 and 78 having a depth equal to the shallow panel 62 and two edges 80 and 82 that are tapered to transition from the high elevation 72 to the low elevation 74. The second transition panel 70, shown in FIG. 19, includes two side edges 84 and 86 having a depth equal to the deep panel 64 and two edges 88 and 90 that are tapered to transition from the high elevation 72 to the low elevation 74. FIG. 13 is a cross-section taken along line 13—13 of FIG. 12 illustrating the deep panel 64, the shallow panel 62, the tapered panel 18, the first transition panel 68 and the second transition panel 70 all suspended from the grid members 28.

Figure 14:
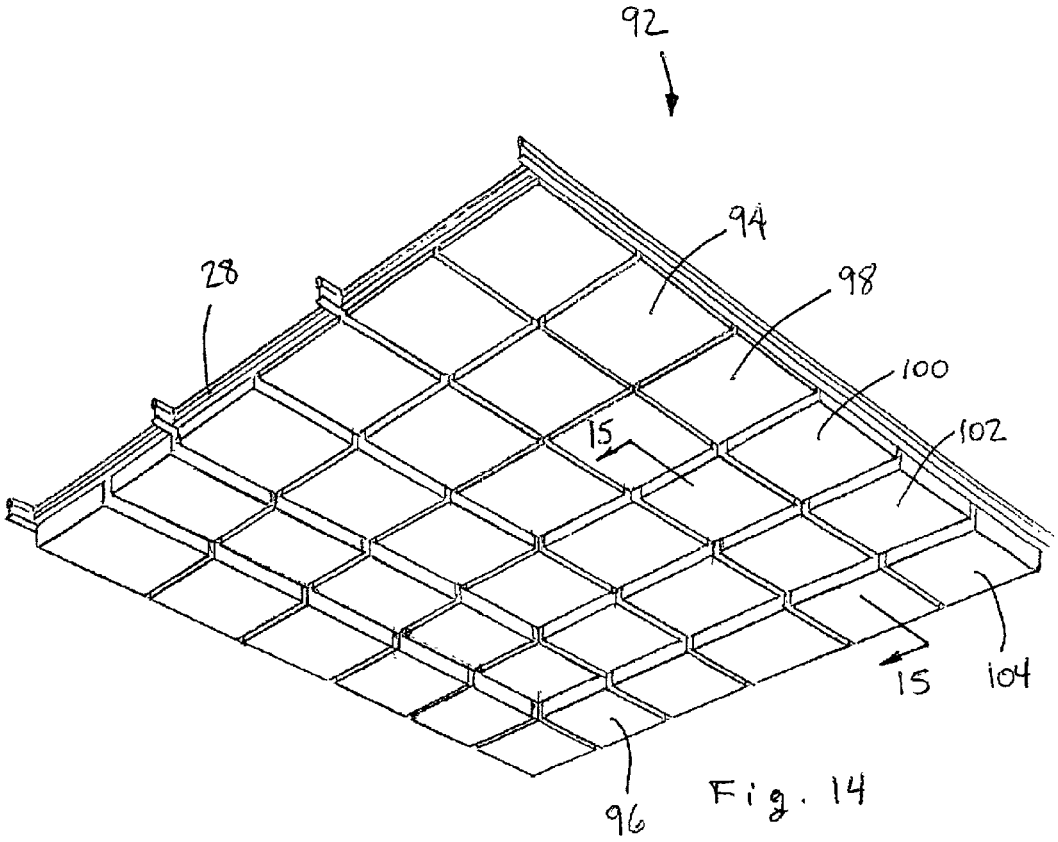
FIG. 14 is a perspective view of the ceiling system illustrating the use of flat panels with various depths to create a tiered pattern.
Figure 15:
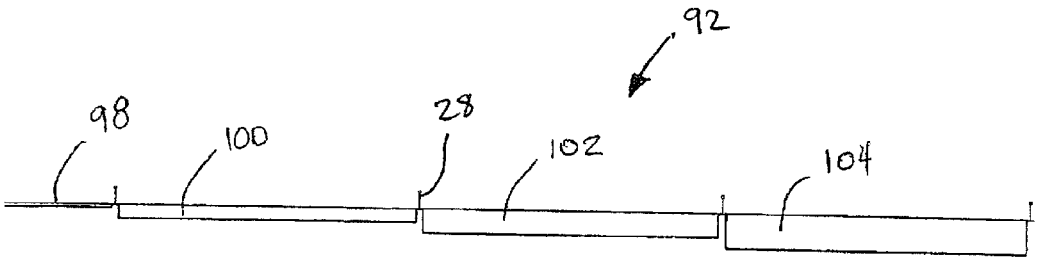
FIG. 15 is a cross-section of FIG. 14 taken along line 15—15 illustrating the panels suspended from the grid members.

FIG. 14 illustrates a variable depth ceiling system 92 having a stepped transition from a high elevation 94 to a low elevation 96. The ceiling system 92 is made up of four different panels 98, 100, 102 and 104 to complete the transition from the high elevation 94 to the low elevation 96. FIG. 15 is a cross-section taken along line 15—15 of FIG. 14 illustrating the transition from the shallow panel 98 to the deep panel 104 by using the two intermediate panels 100 and 102.

Figure 16:
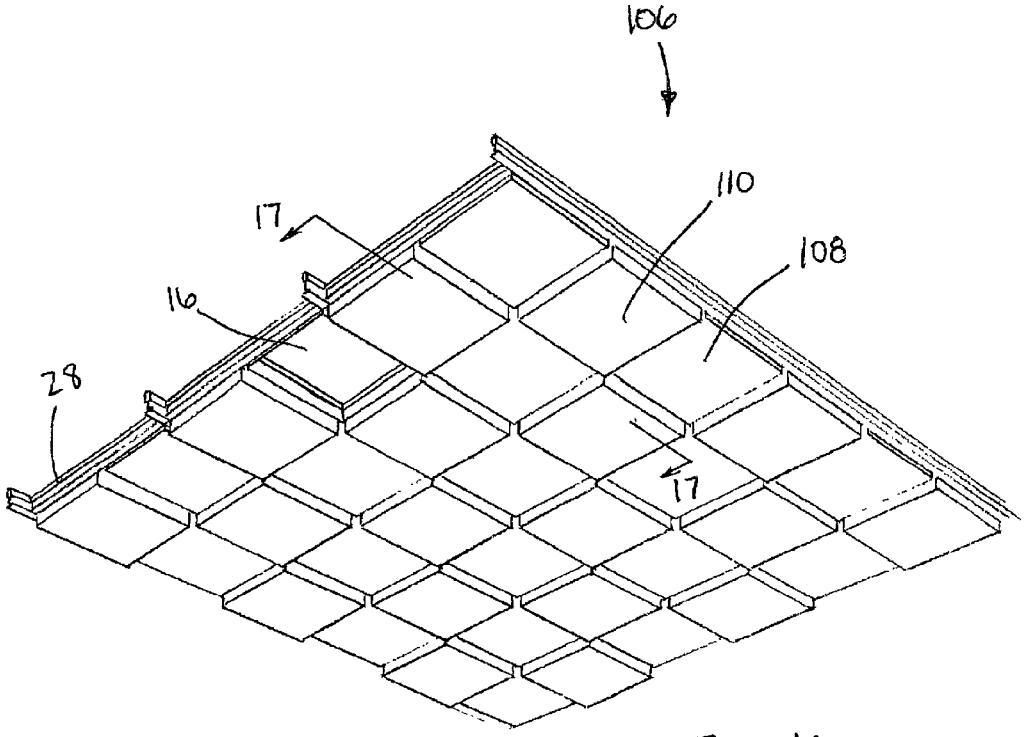
FIG. 16 is a perspective view of the ceiling system illustrating the use of flat panels with two depths to create a checkerboard pattern.
Figure 17:
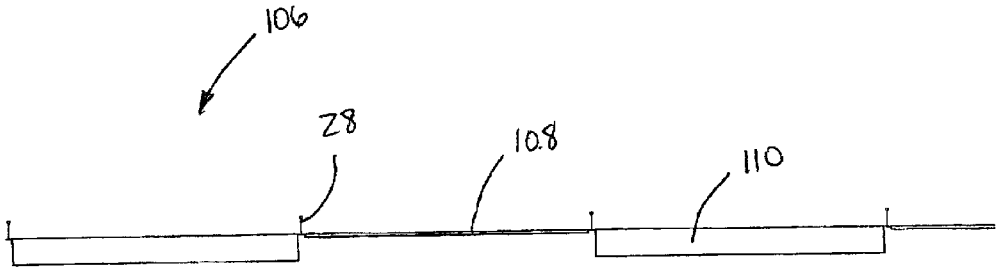
FIG. 17 is a cross-section of FIG. 16 taken along line 17—17 illustrating the panels suspended from the grid members.

FIG. 16 illustrates a variable depth ceiling system 106 utilizing alternating shallow panels 108 and deep panels 110 to create a checkerboard effect. The panels 108 and 110 are designed to fit into a standard grid opening 16. FIG. 17 is a cross-section taken along line 17—17 of FIG. 16 and illustrates the panels 108 and 110 suspended from a set of parallel grid members 28.

Figure 18:
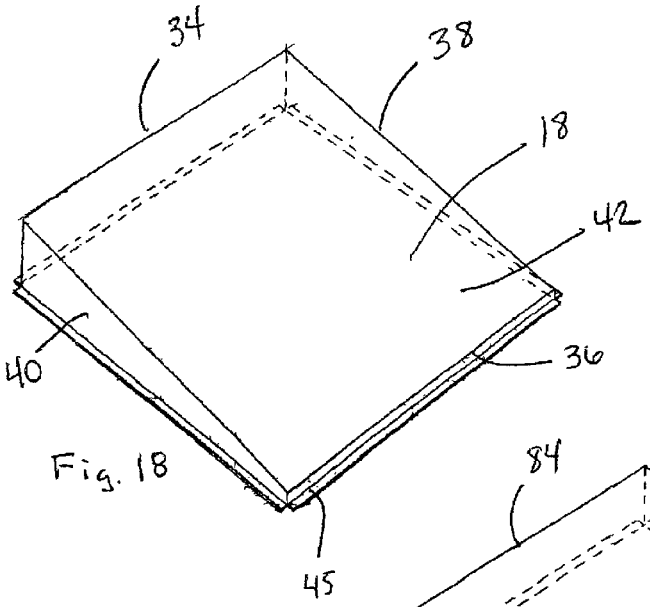
FIG. 18 is a perspective view of a tapered ceiling panel.
Figure 19:
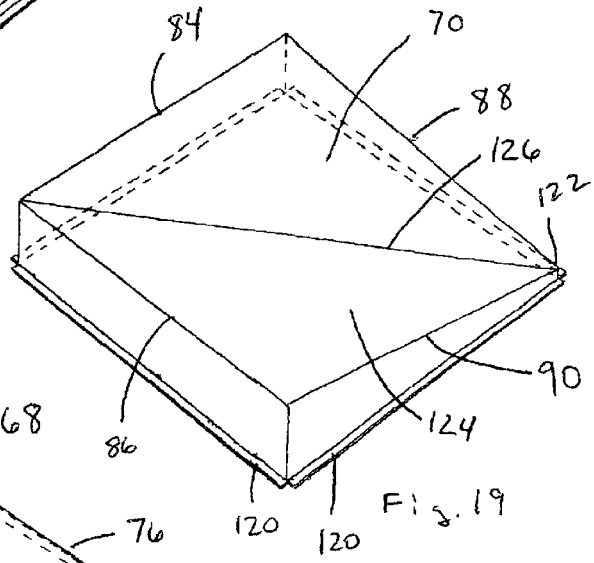
FIG. 19 is a perspective view of a tapered transition panel.
Figure 20:
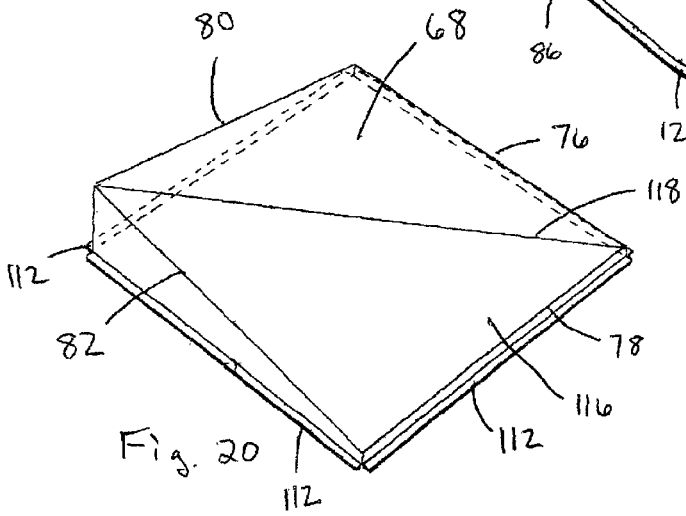
FIG. 20 is a perspective view of another tapered transition panel.

FIGS. 18–20 illustrate the tapered panel 18 and the two transition panels 68 and 70 used to create the ceiling system 58 illustrated in FIG. 12. The first transition panel 68, as shown in FIG. 20, includes the first and second edges 76 and 78 that are rectangular in shape and adapted to transition to the shallow panels 62. The first and second edges 76 and 78 include flanges 112 that are used to support the panel 68 to the base member 20 of the grid members 14 and 28. The flanges 112 are oriented to allow the edges 76, 78, 80 and 82 of the panel 68 to be substantially parallel to the bridge portion 24 of the grid members 14 and 28. The third and fourth edges 80 and 82 are tapered from the first and second edges 76 and 78 to a corner of the panel 68 and also include the flanges 112 used to support the panel 68 from the base member 20 of the grid members 14 and 28. The panel 68 further includes a face surface 116 that includes a diagonal ridge 118 that divides the panel allowing the face surface 116 to transition from the first and second edges 76 and 78 to the third and fourth edges 80 and 82.

The second transition panel 70, as shown in FIG. 19, includes the first and second edges 84 and 86 that are rectangular in shape and are adapted to transition to the deep panel 64. The first and second edges 84 and 86 include flanges 120 that are used to support the second transition panel 70 to the base member 20 of the grid members 14 and 28. The third and fourth edges 88 and 90 are tapered from the first and second edges 84 and 86 to a corner 122 of the panel 70 and also include the flanges 120 used to support the panel 70 from the base member 20 of the grid members 14 and 28. The panel 70 further includes a face surface 124 that includes a diagonal valley 126 that divides the panel allowing the face surface 124 to transition from the first and second edges 84 and 86 to the third and fourth edges 88 and 90.

Figure 21:
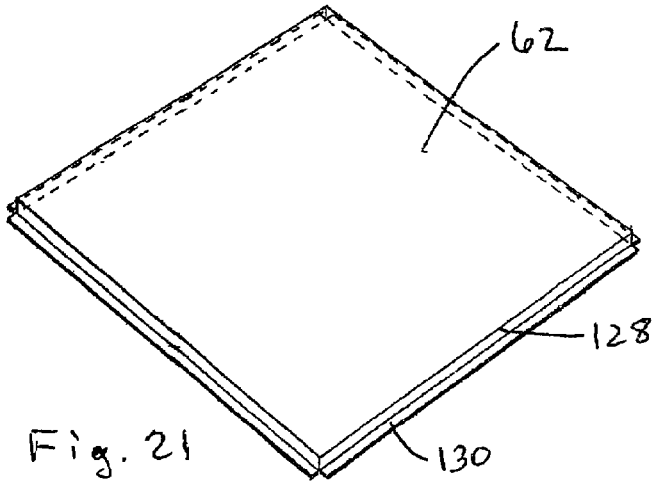
FIG. 21 is a perspective view of a shallow flat panel.
Figure 22:
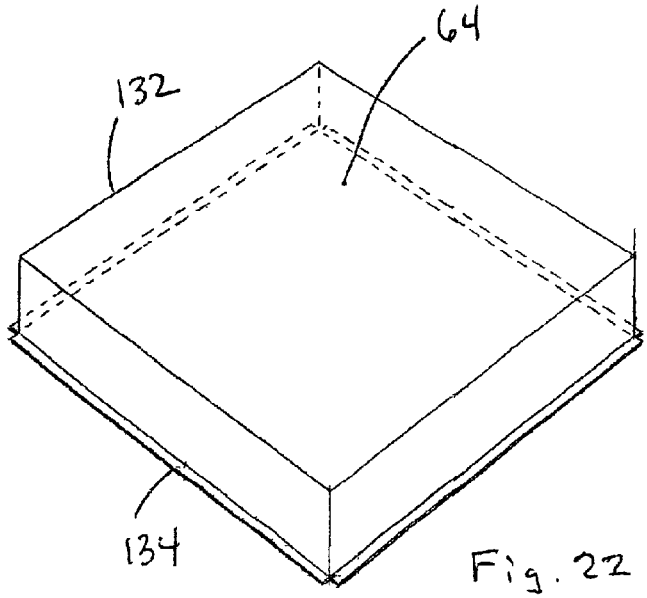
FIG. 22 is a perspective view of a deep flat panel.

FIG. 21 illustrates the shallow panel 62 used in the ceiling systems depicted in FIGS. 12, 14 and 16. The shallow panel 62 has four uniform sides 128 that include outwardly extending flanges 130 to support the panel 62 from the grid 12. FIG. 22 illustrates the deep panel 64 also used in the ceiling systems depicted in FIGS. 12, 14 and 16. The deep panel 64 has four uniform sides 132 that include outwardly extending flanges 134 to support the panel 64 from the grid 12.

Figure 23:
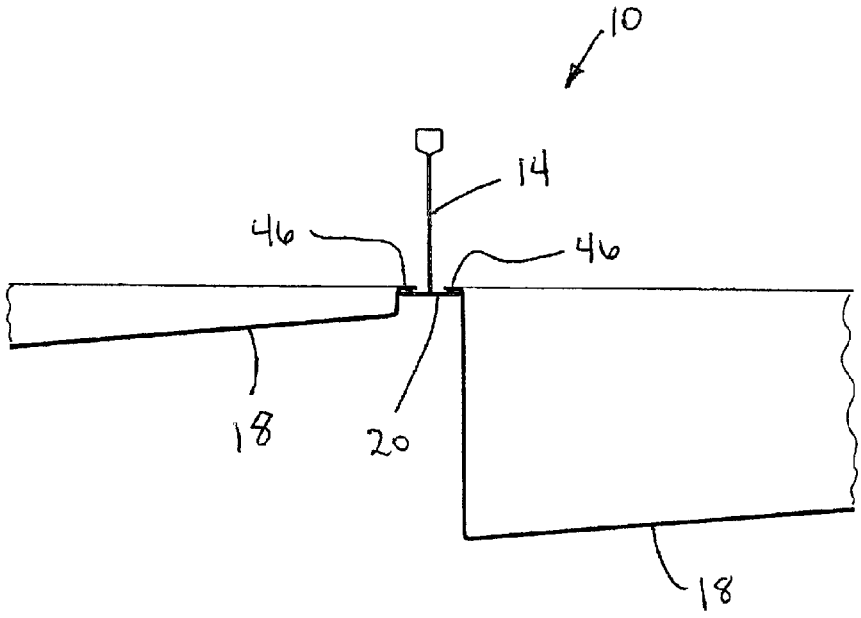
FIG. 23 is a cross-sectional view of a pair of tapered panels supported by a grid member.
Figure 24:
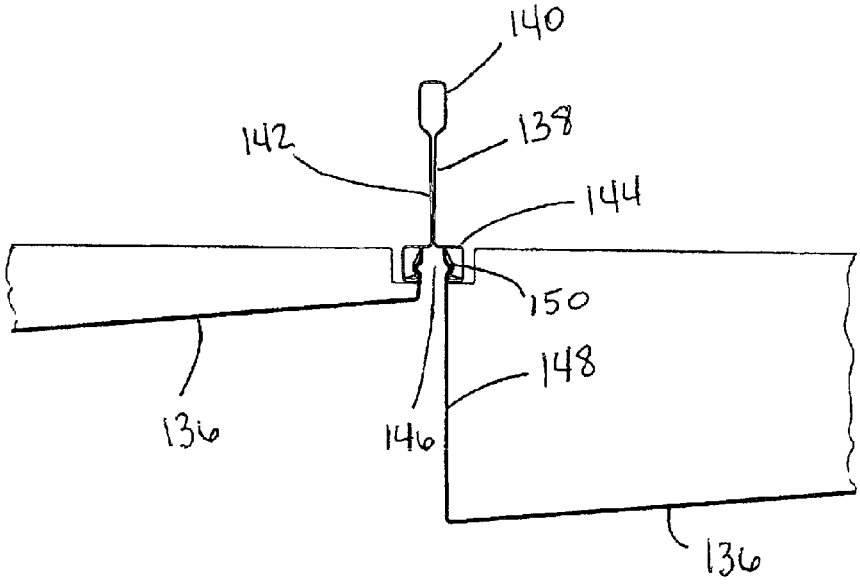
FIG. 24 is a cross-sectional view of an alternate pair of tapered panels connected to a channel type grid member.

FIG. 23 is a cross section of the tapered ceiling system 10 illustrating the connection of the tapered panels 18 to the grid members 14 or 28. The flanges 46 extend outwardly from the sides of the panel 18 and are adapted to rest upon the base member 20 of the grid members 14 or 28. FIG. 24 is an alternate embodiment of the attachment of tapered panels 136 to channel-type grid members 138. The channel-type grid members 138 include a bulb portion 140 a base portion 144 and a bridge portion 142 interconnecting the base portion 144 to the bulb portion 140. The base portion 144 includes a channel 146 that is adapted to support the panel 136. The panel 136 includes sides 148 that include inwardly extending detents 150 that are adapted to retain the panel 136 to the grid member 138.

The use of the tapered panels 18 in a planar grid 12 allows for various ceiling patterns to be configured by simply repositioning the panel in the grid 12. Since the panels 18 are not permanently installed, the panels 18 can be rotated within the grid 12 at a later date to alter the ceiling design.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A suspended multi-planar ceiling system for connection to a structure comprising:

a plurality of grid members intersecting to form a grid, said grid members having a base member and a bridge member; and a plurality of tapered panels adapted to be connected to said grid, said panels having a first upwardly extending side and a second upwardly extending side interconnected by a common surface, said first side having a greater surface area than said second side;

said panels including a first edge formed by the intersection of a third upwardly extending side with the common surface of a panel, said panels further including a second edge formed by the intersection of a fourth upwardly extending side with the common surface of said panel wherein said first edge is substantially parallel with said second edge.

2. The suspended multi-planar ceiling system of claim 1, wherein said first side includes an outwardly extending flange.

3. The suspended multi-planar ceiling system of claim 2, wherein said second side includes an outwardly extending flange.

4. The suspended multi-planar ceiling system of claim 3, wherein said flanges are in contact with said base member of said grid members.

5. The suspended multi-planar ceiling system of claim 1, wherein said tapered panels are arranged in said grid in the same direction to form a shingle pattern.

6. The suspended multi-planar ceiling system of claim 1, wherein said tapered panels in a first row are arranged 180 degrees out of phase with panels in a second row to form a saw-tooth pattern.

7. The suspended multi-planar ceiling system of claim 1, wherein said first side of a first panel is adjacent to said first side of a second panel to form an undulating pattern.

8. The suspended multi-planar ceiling system of claim 1, wherein said first side of said second panel is offset 90 degrees from said first side of said first panel to form a pinwheel patter.

9. A multi-planar ceiling system comprising:

a grid formed from an interconnection of a plurality of grid members, said grid members including a substantially vertical component and a substantially horizontal component;

a first and a second planar panels adapted to be suspended from said grid and including a substantially horizontal bottom surface and a plurality of side surfaces extending upwardly from said bottom surface, said side surfaces of said first and second planar panels are substantially parallel to said substantially vertical component of said grid members; said bottom surface on said first planar panel extends further from said grid than said bottom surface of said second planar panel, a tapered panel adapted to be suspended from said grid, said tapered panel including a bottom surface that lies in a non-horizontal plane and having two tapered parallel edges; said tapered panel further including a first side surface having a length equal to said side surfaces of said first panel and including a second side surface having a length equal to said side surfaces of said second panel.

10. The multi-planar ceiling system of claim 9, wherein said panels further include outwardly extending flanges that are adapted to contact said substantially horizontal component of said grid members.

11. The multi-planar ceiling system of claim 9, wherein said tapered panel further includes a third and a fourth side surface that are tapered transitioning from said first side surface to said second side surface.

* * * * *